US006045380A

United States Patent [19]

Hashimoto

[11] Patent Number: 6,045,380

[45] Date of Patent: Apr. 4, 2000

[54] MOVABLE CONNECTOR

[75] Inventor: Shinichi Hashimoto, Tokyo, Japan

[73] Assignee: The Whitaker Corporation, Wilmington, Del.

[21] Appl. No.: 09/109,277

[22] Filed: Jun. 30, 1998

[30] Foreign Application Priority Data

Jun. 30, 1997 [JP] Japan ..... 9-189190

[51] Int. Cl.[7] ..... H01R 13/64

[52] U.S. Cl. ..... 439/248

[58] Field of Search ..... 439/247, 248, 439/78, 79, 83, 607

[56] References Cited

U.S. PATENT DOCUMENTS

| | | | |
|---|---|---|---|
| 4,808,115 | 2/1989 | Norton et al. | 439/79 |
| 4,808,125 | 2/1989 | Waters et al. | 439/607 |
| 5,201,663 | 4/1993 | Kikuchi et al. | 439/248 |
| 5,259,779 | 11/1993 | Ooya et al. | 439/247 |
| 5,842,885 | 12/1998 | Takamoto et al. | 439/607 |
| 5,876,247 | 3/1999 | Hashimoto | 439/607 |

FOREIGN PATENT DOCUMENTS

| | | | |
|---|---|---|---|
| 7-230858 | 8/1995 | Japan | H01R 23/02 |

*Primary Examiner*—Michael L. Gellner
*Assistant Examiner*—Antoine Ngandjui

[57] ABSTRACT

A movable connector with excellent shielding performance and transmission characteristics is provided. A second housing (2) is floatably attached via electrical contacts (20) to a first housing (50) that is mounted on a circuit board. Shields (80) are attached around an outer periphery of the second housing (2), and protrusions (24e) provided on specific contacts (20) are connected to the shields (80), thereby resulting in grounding connections.

11 Claims, 6 Drawing Sheets

MOVABLE CONNECTOR

FIELD OF THE INVENTION

The present invention relates to an electrical connector, and more particularly relates to a movable connector that absorbs positional shift during the mating of connectors attached to circuit boards.

BACKGROUND OF THE INVENTION

Electrical connectors are a known structure in which part of the connector is movable so that any positional shift between connectors attached to circuit boards during their mating will be absorbed. An example of such a connector is disclosed in Japanese Patent Publication No. 7-230858, which is shown in FIG. 9. Connector 100 has an inner housing 106 inside a cavity 104 in an outer housing 102. Inner housing 106 is movably supported within the cavity 104 by a cantilever arm 108 of a ground contact 107. The ground contact 107 has a band-shaped plate from which cantilever arm 108 extends. A plurality of electrical contacts 110 and the ground contact 107 are each independently connected to a circuit board (not shown).

In the known example given above, the ground contact 107 is not constructed so as to cover an outer periphery of the housing 102; it is instead attached to the circuit board independently from the contacts 110, so cross-talk between the contacts cannot be prevented.

The present invention provides a movable connector that is a floating type of connector while still grounding specific contacts to achieve excellent shielding performance and transmission characteristics.

SUMMARY OF THE INVENTION

The movable connector of the present invention comprises a first housing that is attached to a circuit board, and a second housing that is floatably attached to the first housing via electrical contacts and engages with a mating connector, wherein the movable connector includes a metal shield covering approximately an outer periphery of the second housing, and certain contacts of the electrical contacts are in electrical engagement with the shield.

It is preferable for a resilient arm to be provided by the shield, and for the resilient arm to be in electrical engagement with the electrical contacts.

It is also preferable for the shield to be sandwiched between electrical contacts.

It is further preferable for the shield to be in electrical engagement on both sides thereof with mounting sections of the contacts.

It is additionally preferable for the first and second housings to be positioned one over the other, for the shield to be fixed to the second housing, and for the electrical contacts to be in electrical engagement with the shield with no resiliency at the second housing portion.

BRIEF DESCRIPTION OF THE DRAWINGS

Embodiments of the present invention will now be described by way of example with reference to the accompanying drawings, in which.

DETAILED DESCRIPTION OF THE INVENTION

Figure 1:
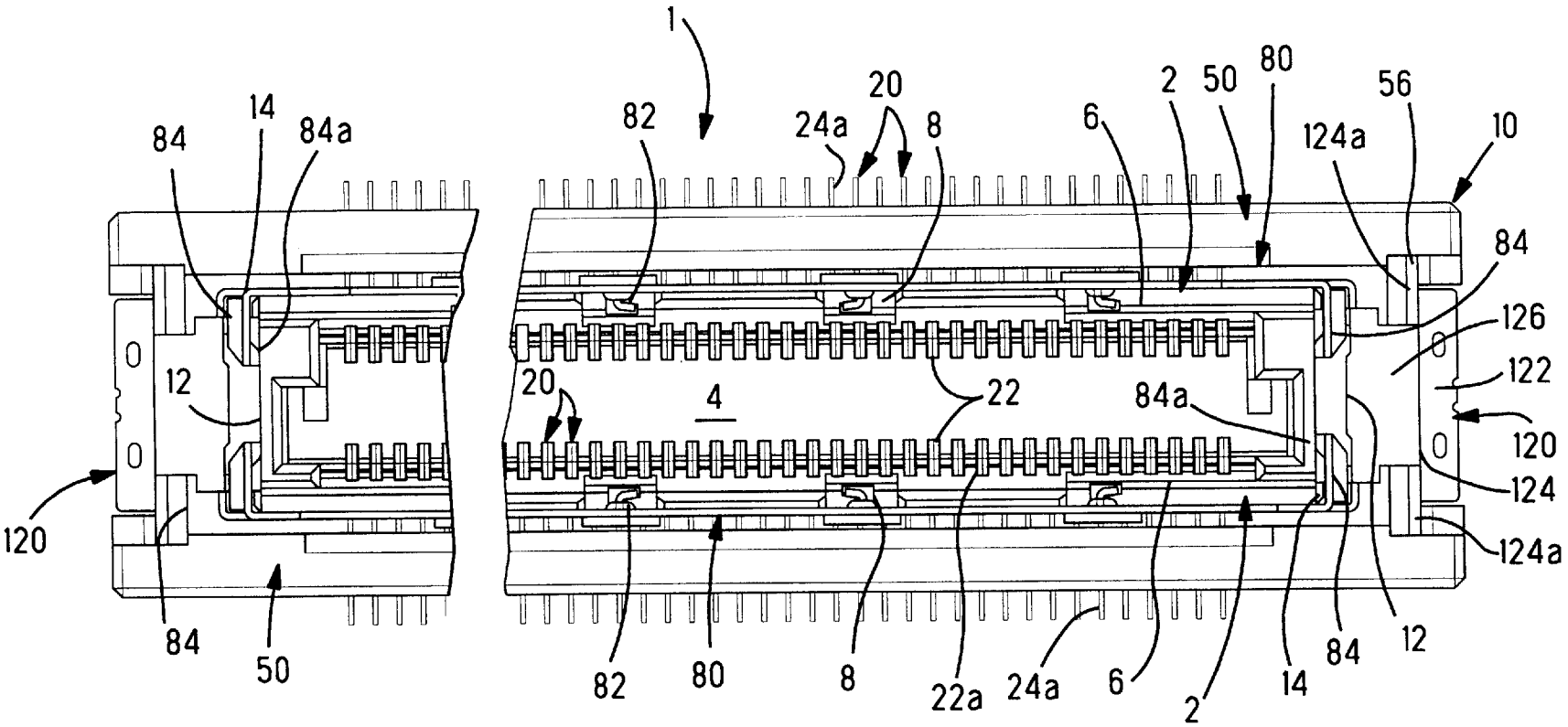
FIG. 1 is a front view of a movable connector of the present invention.

Referring to FIG. 1, a generally rectangular inner or second insulated housing 2 has a cavity 4 that receives a mating connector (not shown). The housing 2 is disposed within an outer or first housing 50 with a generally box-like shape that surrounds the housing 2. The housing 2 and the housing 50 are integrally linked during their molding, but are separated in a subsequent step. The housings 2 and 50 will be collectively referred to as connector housing 10.

A plurality of electrical contacts 20 are arranged along the length of the connector housing 10. The contacts 20, which are stamped from a metal sheet, comprise contact sections 22 that electrically engage with mating contacts (not shown) of the mating connector, and they are disposed inside the cavity 4 of the housing 2, and mounting sections 24 that are disposed along the housing 50. Two metal shields 80 are attached around the outer periphery of the housing 2 along sides 6 thereof. The inner housing 2, outer housing 50, electrical contacts 20 and shields 80 form electrical connector 1. A plurality of tongues 82, which are cut out and raised up from metal shields 80, are formed in a lengthwise direction of the shields 80. The tongues 82 are bent in the above-mentioned lengthwise direction, and are formed such that adjacent tongues 82 face in opposite directions.

L-shaped grooves 8 receive the tongues 82 and are formed on the sides 6 of the housing 2 in locations corresponding to that of the tongues 82. As a result, the shields 80 can be attached to the housing 2 by pressing them from above and moving them along each side 6 of the housing 2 until the tongues 82 engage grooves 8. The two end sections 84 of the shields 80 are bent at right angles and extend along ends 12 of the housing 2. Inward-facing dimples or beads 84*a* are formed at the distal ends of the end sections 84, and they are designed such that when they engage with the ends 12 of the housing 2, the shields 80 are in a specific positional relationship with the housing 2. Meanwhile, beads 14, that extend perpendicular to a circuit board on which connector 1 is to be mounted and connected thereto, are formed on both sides of the ends 12 of the housing 2. The purpose of the beads 14 will be discussed below.

Circuit board mounting members 120 are attached at both ends of the housing 50. The mounting members 120 have a surface-mounting section 122 that engages with the circuit board, an attachment section 124 that extends perpendicularly upward from the surface-mounting section 122, and an extension 126 that extends from the attachment section 124 toward the shields 80. Attachment to the housing 50 is accomplished by pressing tabs 124*a* on both ends of the mounting members 120 into slots 56 in the housing 50. Protrusions 128 (FIG. 4) extend down from edges of the extension 126 and engage with the end sections 84 of the shields 80. As a result, the shields 80 are grounded to the circuit board via the mounting members 120.

Figure 2:
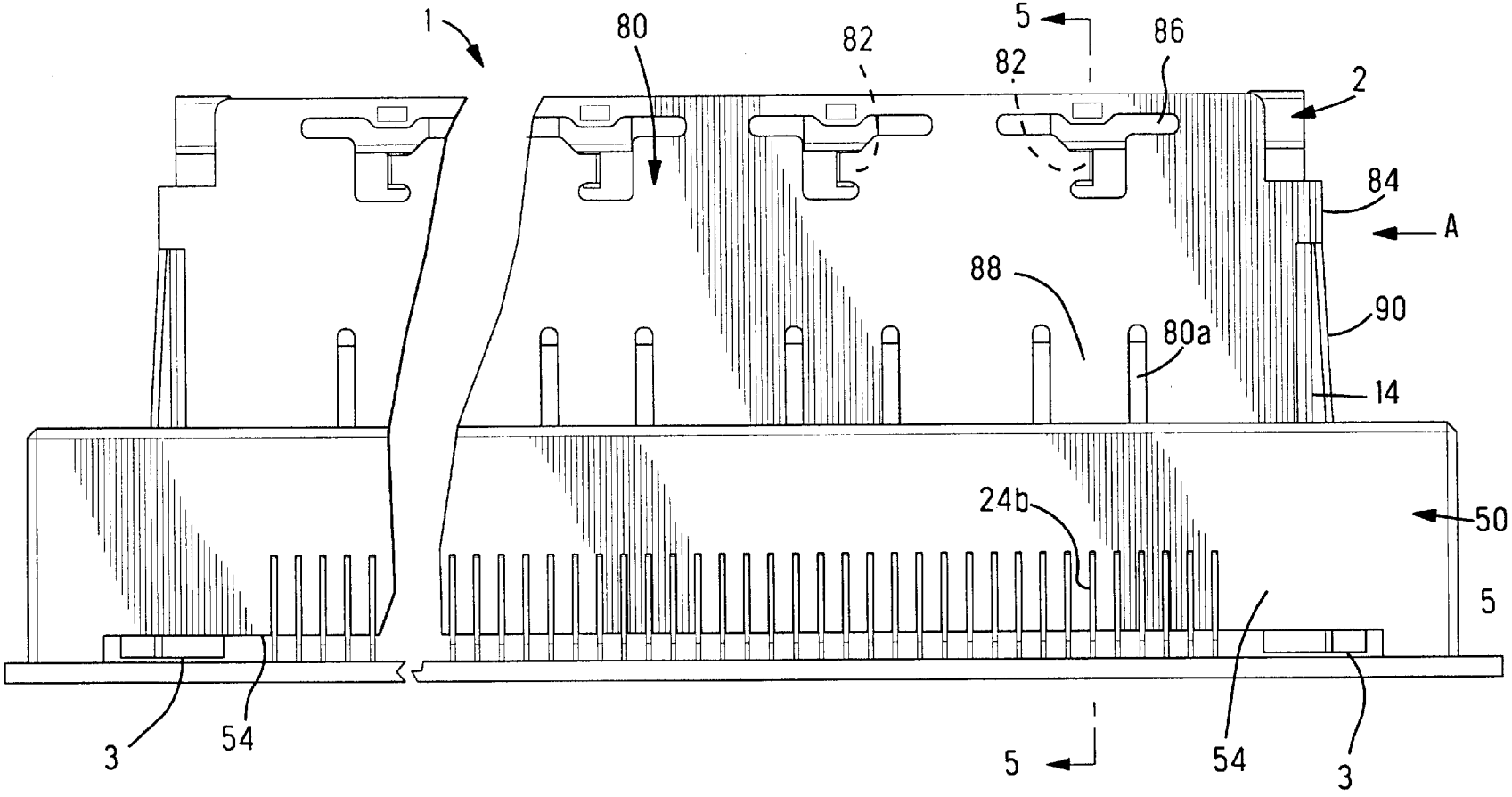
FIG. 2 is a side view of the movable connector in FIG. 1.
Figure 5:
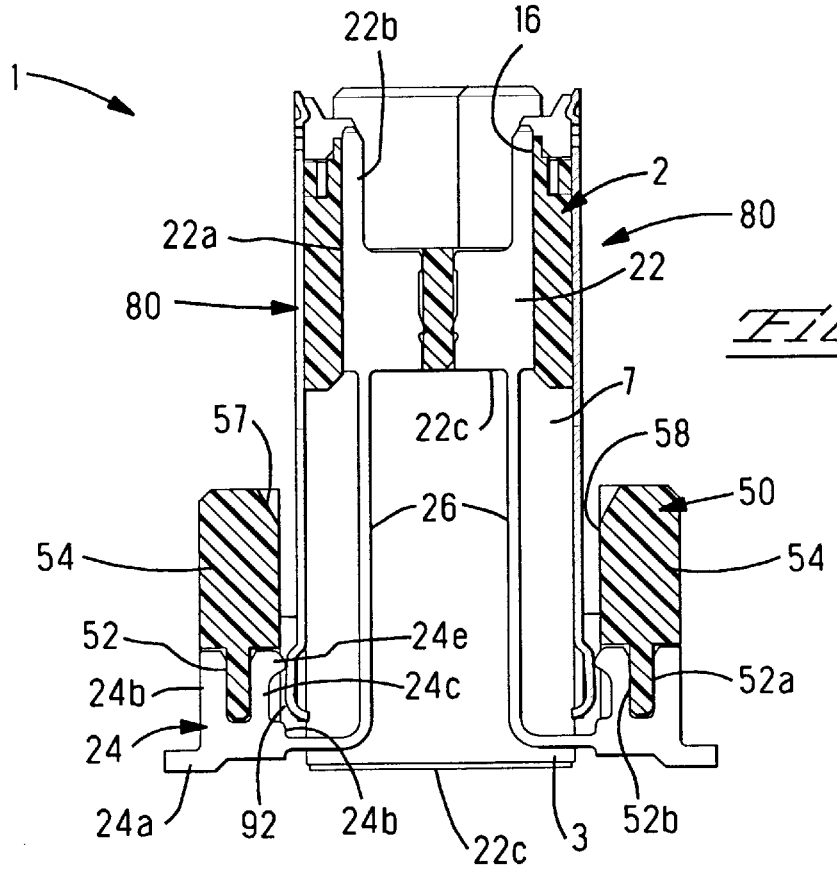
FIG. 5 is a cross-sectional view taken along line 5—5 in FIG. 2.

Next, referring to FIG. 2, openings 86 are provided at specific intervals along the shields 80 that more or less cover the sides 6 of the housing 2, and the tongues 82 are formed in the openings 86. A plurality of slots 80*a* are located at specific intervals from about midway of the height of the shields 80 down, thereby forming resilient arms 88. A plurality of grooves 52 are located facing upward from bottom surfaces in walls 54 of the housing 50 (FIG. 5). The mounting sections 24 of the contacts 20 are pressed into and held in the grooves 52. This results in the linking of the two housings 2 and 50 by the contacts 20. Floor sections 3 at both ends of the housing 2 are raised slightly from the circuit board 5, allowing for floating relative to the housing 50. Spring tabs 90 extend down and slightly to the outside from the end sections 84 of the shields 80.

Figure 3:
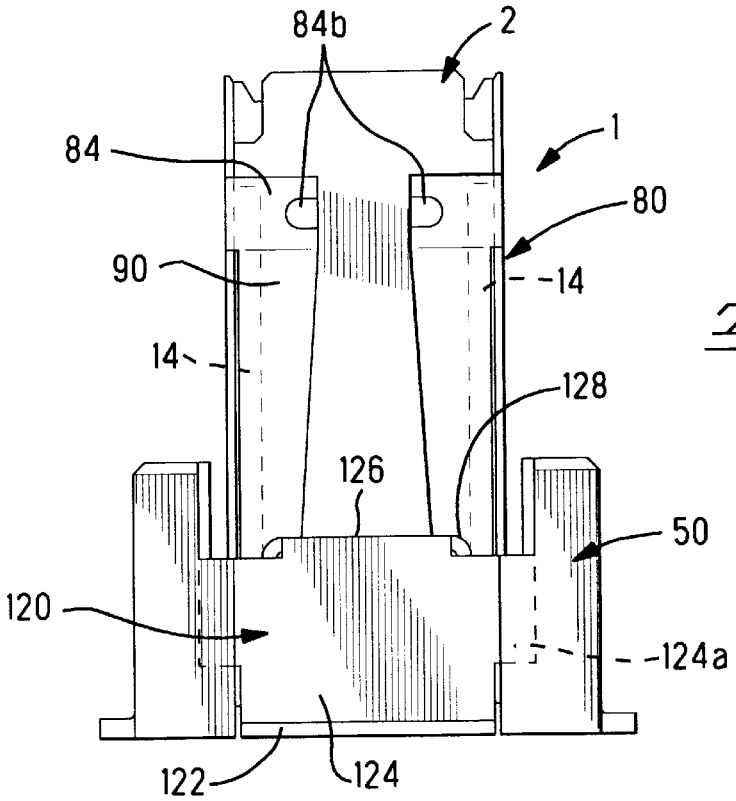
FIG. 3 is an end view of the connector in FIG. 1.

The end sections 84 and the spring tabs 90 of the shields 80 will now be described further through reference to FIGS. 3 and 4, which is a part cross-sectional view in which an end section of the housing 50 has been partly cut away. It should be clear that the spring tabs 90, which taper to the inside, extend down from the lower ends of the end sections 84. The beads 14 of the housing 2 are more or less in engagement with the end sections 84, but usually do not engage the spring tabs 90. However, when the housing 2 moves in its lengthwise direction, the spring tabs 90 deflect and engage with the beads 14, thus limiting further movement of the housing 2.

Figure 4:
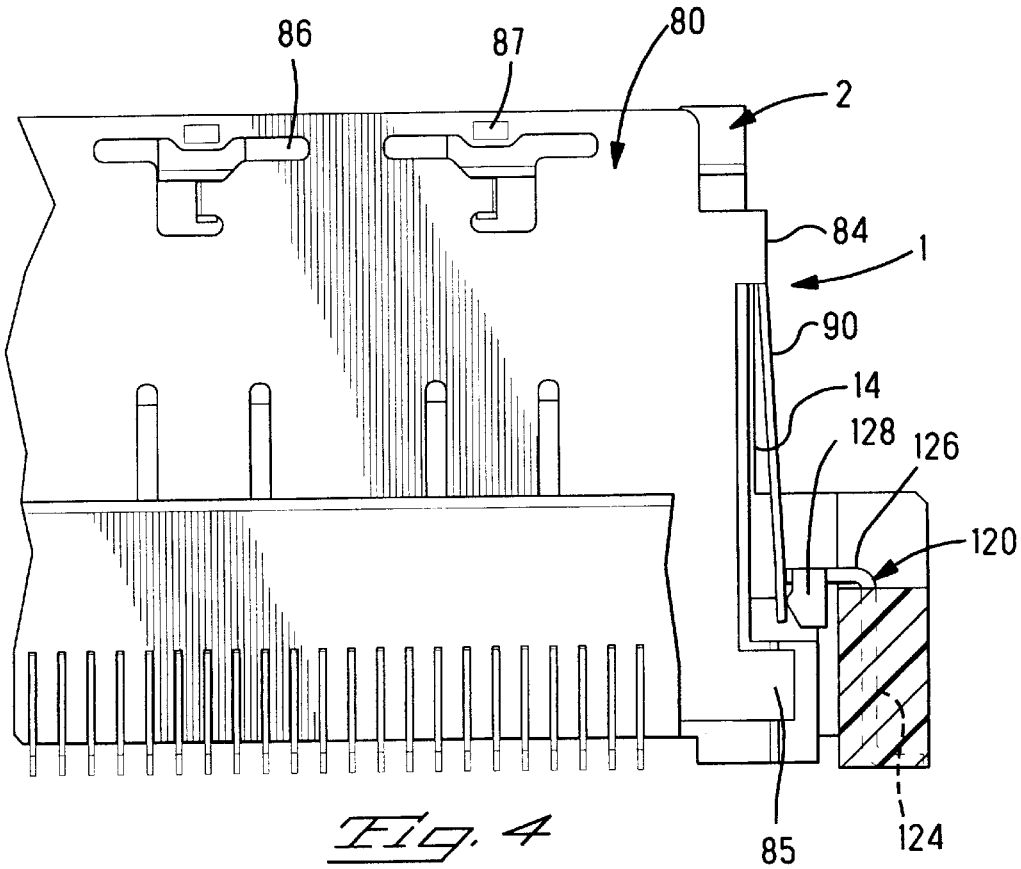
FIG. 4 is a part side view in which part of the connector in FIG. 1 has been cut away.

It should be clear from FIG. 4 that the lower portions of the spring tabs 90 are in a state of engagement with the protrusions 128 of the mounting members 120. The ends 85 of the lower portions of the shields 80 extend outward, and curve in toward the ends 12 of the housing 2.

Square dimples 87 that protrude away from the viewer FIG. 4 are arranged at specific intervals in the vicinity of the upper edge of the shields 80. The dimples are grounded through electrical engagement with the shields of the mating connector. The openings 86 extend to the left and right below the dimples 87, that is, in the lengthwise direction of the shields 80, thereby imparting resiliency to the dimples.

The contact sections 22 of the contacts 20 arranged in two rows are pressed into and held in contact-receiving cavities 16 in the housing 2 as shown in FIG. 5. The contact sections 22 have distal end sections 22*b* that extend along outer edges 22*a* thereof, and are electrically connected with the mating contacts through engagement with the distal end sections 22*b*. The mounting sections 24 frictionally attached to the grooves 52 in side walls 54 of housing 50 have tines 24*a* that are soldered to contact pads of the circuit board 5 (FIG. 2), and separate legs 24*b* and 24*c* that are pressed into the grooves 52. The grooves 52 comprise recesses 52*a* extending to an outer surface 56 of walls 54 and recesses 52*b* extending to an inner surface 58 that receive the legs 24*b* and 24*c* of mounting sections 24.

The mounting sections 24 and contact sections 22 are linked by linking sections 26. The linking sections 26 comprise slender L-shaped portions that link lower end edges 22*c* of the contact sections 22 with end edges 24*d* on the inside of the mounting sections 24. Protrusions 24*e* that protrude from the inner surface 58 of walls 54 are provided to the distal ends of the legs 24*c* of the mounting sections 24, and the protrusions 24*e* are in engagement with arcuate sections 92 provided to the lower ends of the shields 80. The protrusions 24*e* are only provided to some of the contacts 20, namely, those contacts 20 that are at specific intervals. Specifically, those contacts 20 with protrusions 24*e* are used as grounding contacts, and those contacts 20 without protrusions 24*e* do not engage with the shields 80 and are used as signal contacts 20. The housing 2 is able to move slightly to the left and right in FIG. 5 inside the housing 50 by means of the flexibility of the resilient arms 88 of the shields 80 and the linking sections 26. As the housing 2 moves, adjacent linking sections 26 bend similarly, so that no engagement between the linking sections 26 takes place even though they are not far apart.

An example of the assembly of the connector 1 will now be given. The contacts 20 are pressed into the housing 2 and housing 50 from below. The shields 80 are inserted and attached to the housing 2 from above. Here, the taper 57 of the housing 50 serves as a guide for the shields 80, thereby allowing them to be mounted in place more smoothly. The housing 2 and the housing 50 are then cut apart. This is not the only assembly method possible, and various modifications can be made to this procedure. The housing 2 and the housing 50 are usually linked at both ends, but may instead be linked at other suitable portions.

Figure 6:
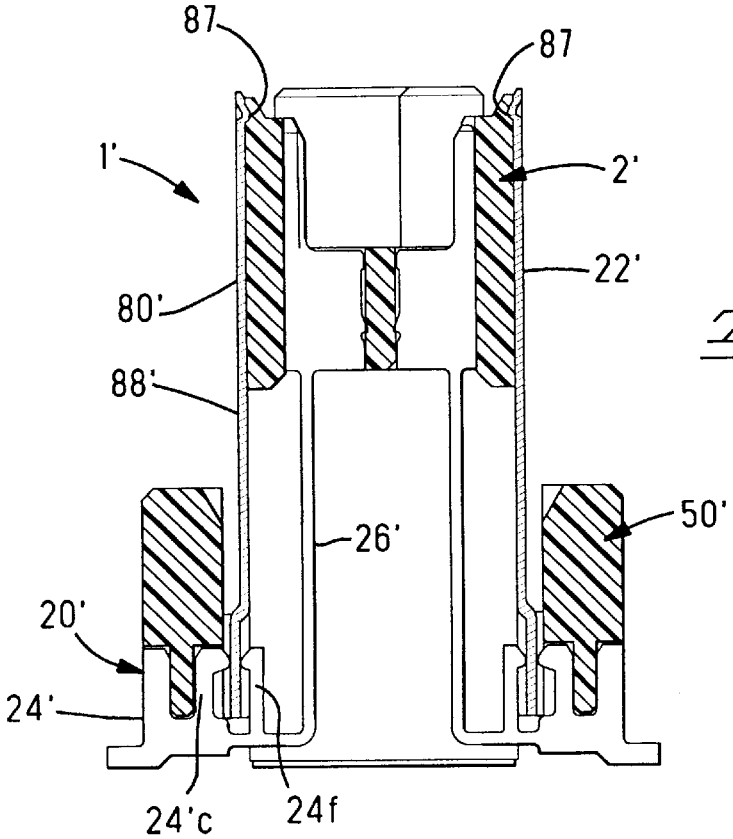
FIG. 6 is the same cross-sectional view as in FIG. 5, showing an alternative embodiment of the present invention.

Next, FIG. 6 shows a connector 1' as an alternative embodiment. The components that are similar to those in the above embodiment have a prime sign added to their number. The connector 1' differs from the connector 1 in terms of the mounting sections 24' of the electrical contacts 20'. The mounting sections 24' have a leg 24*f* provided along the inside of the resilient arms 88' and to the right of the leg 24'*c*. The engagement here is such that the lower ends of the resilient arms 88' are sandwiched between the legs 24'*c*, so the contact pressure therebetween is kept substantially constant. The linking sections 26' extend from the lower portion of the legs 24*f* to the contact sections 22'. Connector 1' can be assembled by the same method as in connector 1.

Figure 7:
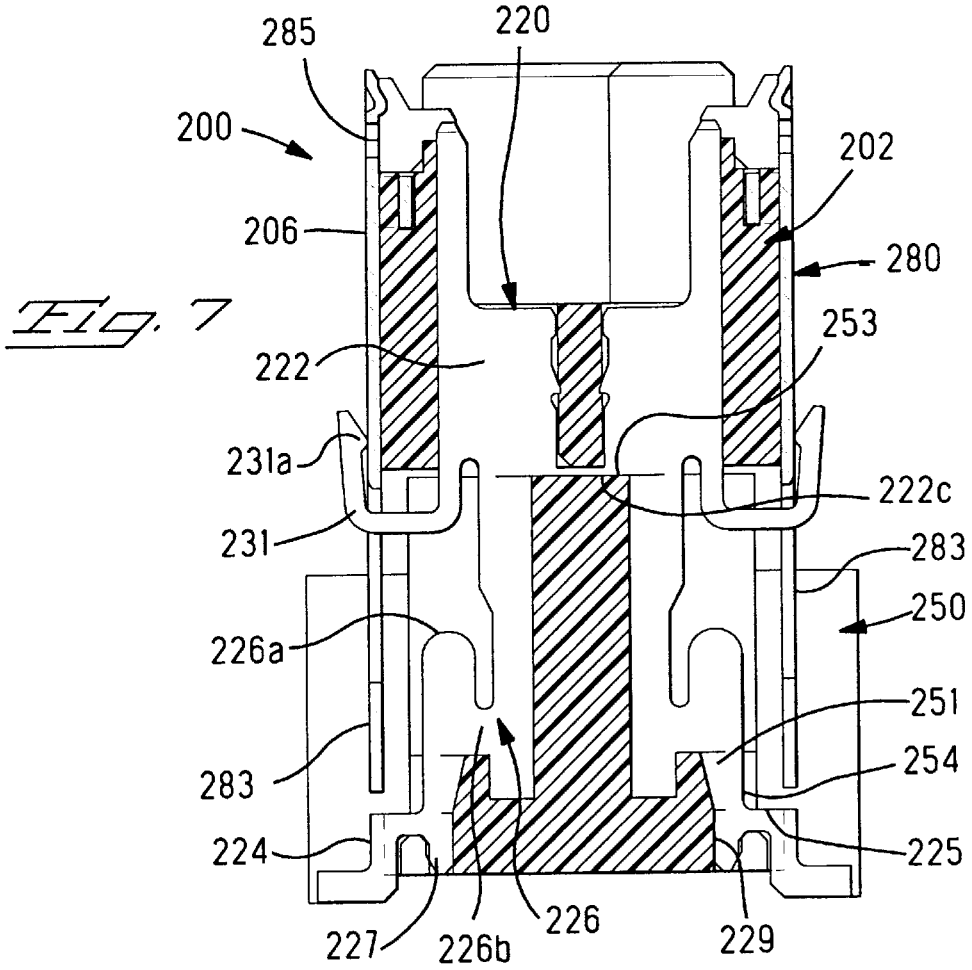
FIG. 7 is the same cross-sectional view as in FIG. 5, showing another embodiment of the present invention.

Connector 200 is another embodiment and will now be described through reference to FIGS. 7 and 8. The connector 200 has a lower housing (first housing) 250, and an upper housing (second housing) 202 positioned over the housing 250 via electrical contacts 220. Housings 202,250 are formed separately. The housing 250 has an upper surface 253, and the force to which the housing 202 is subjected during the mating of a mating connector (not shown) is stopped at upper surface 253.

The contacts 220 are formed integrally with mounting sections 224 via linking sections 226 from the lower end edges 222*c* of contact sections 222, just as in the other above embodiments. The linking sections 226 extend via bent portions 226*a*,226*b* that extend in opposite directions forming a generally S-shape, so that the overall length is greater and also an attendant increase in flexibility. Downward-facing legs 227 are provided on the mounting sections 224. Slots 229 that correspond to the legs 227 are provided in a bottom wall of the housing 250. Assembly is accomplished by pressing the contacts 220 into the housing 202, then pressing the housing 250 upward with the legs 227 aligned with the slots 229, so that the legs 227 are pressed into the slots 229. Here, the mounting sections 224 are fixed in a jig (not shown) so that they will not move.

When the contacts 220 are used for grounding, ground contacts 231 are provided that extend outward in an approximate U-shape from the lower end edges 222*c* of the contact sections 222. Protrusions 231*a* are provided on the inside of the distal ends of the ground contacts 231, and they are in engagement with an outer surface 285 through slots 283 in shields 280. When the contacts 220 are used for signals, the ground contacts 231 are not provided.

Approximately the lower half of the shields 280 are not in engagement with side surfaces 206 of the housing 202, and they also cover the side surfaces of the housing 250. In the case of the embodiment of FIGS. 7 and 8, since the lower ends of the shields 280 are not engaged with the mounting sections 224 of the contacts 220, the housing 202 is displaced by just a light force, the advantage of which is easier alignment. The lower portions of the linking sections 226 of the contacts 220 are inside the grooves 251 of the housing 250. Accordingly, even if the movement of the housing 202 is accompanied by movement of the shields 280 to the left and right in FIG. 7, the shields 280 will not engage with the linking sections 226. Specifically, the lower portions of the shields 280 strike the side walls 254 of the housing 250, so further movement of the shields 280 is prevented.

Figure 8:
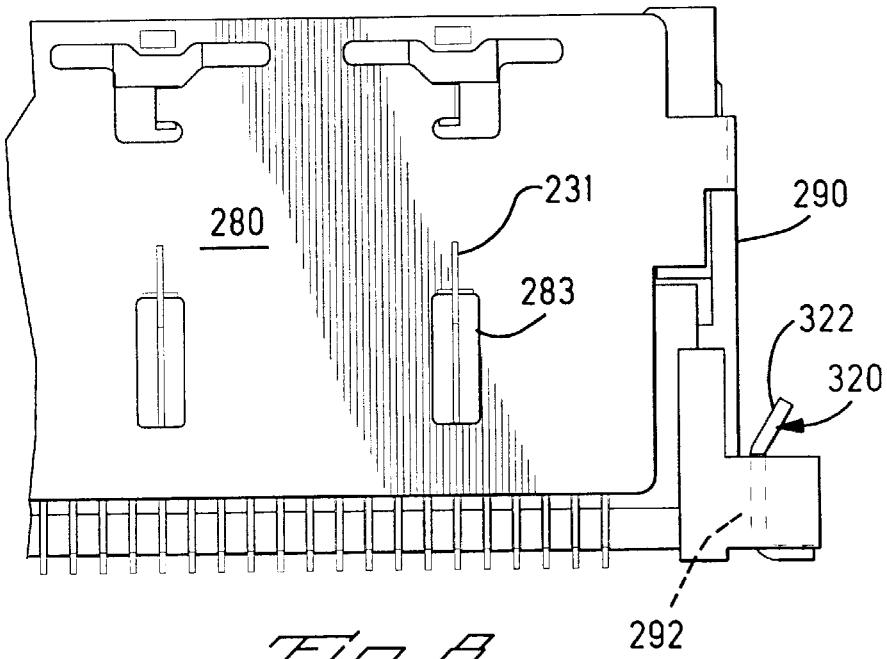
FIG. 8 is a part side view of the connector in FIG. 7.
Figure 9:
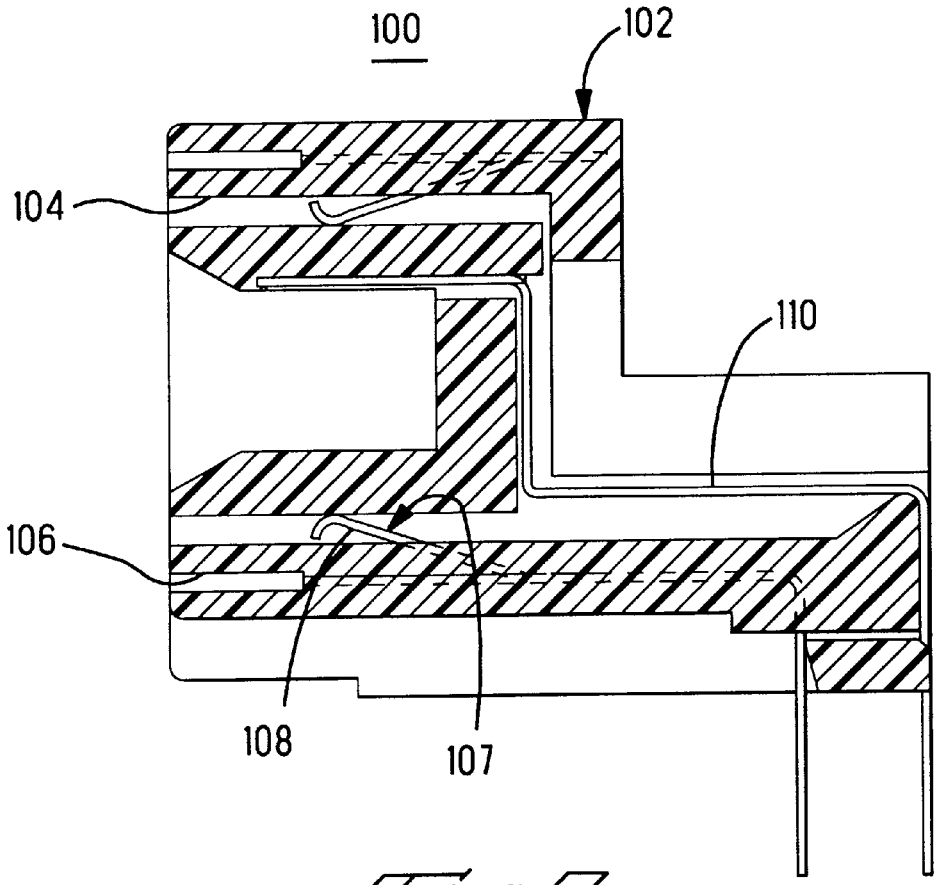
Fig. 9 PRIOR ART
FIG. 9 is a cross-sectional view of a conventional connector.

FIG. 8 is a side view of the other embodiment. The slots 283 in the shields 280 are formed in a rectangular shape that are longer vertically. The shields 280 are attached by pressing the housing 202 downward from above, just as in the other embodiments. Here, at first the shields 280 are pushed against the side surfaces 206 of the housing 202, after which they are lowered and pressed in the same manner as in the other embodiments. The mounting members 320 in the other embodiment are formed by bending a flat metal sheet in an L-shape and further bending upper portion 322 outwardly. The spring tabs 290 of the shields 280 have dimples 292 formed at the free end thereof, and the dimples 292 engage with the mounting members 320.

The movable connector of the present invention is structured such that shields are provided around an outer periphery of a movable second or inner housing, and certain specific electrical contacts of the electrical contacts that link the second housing to a fixed first or outer housing are in engagement with the shields.

Specifically, since the shields cover the outer periphery of the second housing and ground specific electrical contacts, optimum shielding performance and transmission characteristics are obtained.

It is claimed:

1. A shielded electrical connector, comprising:

a first dielectric housing and a second dielectric housing;

electrical contacts having contact sections disposed in the second housing and mounting sections secured to the first housing;

linking sections extending between the contact sections and the mounting sections linking the first housing and the second housing so that the second housing is movable relative to the first housing;

a metal shield mounted to on the second dielectric housing and covering substantially an outer periphery thereof; and selected electrical contacts having protrusions in the form of contact members electrically engaging the metal shield.

2. A shielded electrical connector as claimed in claim 1, wherein the linking sections are L-shaped.

3. A shielded electrical connector as claimed in claim 1, wherein the linking sections are S-shaped.

4. A shielded electrical connector as claimed in claim 1, wherein mounting members are located at ends of the first housing, and spring tabs are provided by the shield in electrical engagement with said protrusions on the mounting sections.

5. A shielded electrical connector as claimed in claim 1, wherein the shield has slots therealong, and selected contact sections have U-shaped ground contacts extending through the slots and in electrical engagement with the shield.

6. A shielded electrical connector as claimed in claim 1, wherein said shield includes slots at intervals along a bottom section of the shield forming resilient arms in engagement with said protrusions.

7. A shielded electrical connector as claimed in claim 1, wherein the shield includes openings having tongues therein, said tongues engaging grooves in the second housing thereby attaching the shield thereto.

8. A shielded electrical connector as claimed in claim 1, wherein metal mounting members are secured in ends of the first dielectric housing and have protrusion members in electrical engagement with spring tabs of said metal shield.

9. A shielded electrical connector as claimed in claim 1, wherein the first housing has grooves, the mounting sections have legs frictionally secured in the grooves.

10. A shielded electrical connector as claimed in claim 9, wherein one of the legs of the mounting sections of the selected electrical contacts have said protrusions engaging the shield.

11. A shielded electrical connector as claimed in claim 9, wherein the mounting sections of the selected electrical contacts have another leg in engagement with an inside surface of the shield.

* * * * *